United States Patent [19]

Schwarze

[11] Patent Number: 4,567,745

[45] Date of Patent: Feb. 4, 1986

[54] TUBE BENDING MACHINE

[76] Inventor: Rigobert Schwarze, Olpener Str. 460-474, 5000 Köln 91, Fed. Rep. of Germany

[21] Appl. No.: 594,770

[22] Filed: Mar. 26, 1984

[30] Foreign Application Priority Data

Mar. 26, 1983 [DE] Fed. Rep. of Germany ..... 3311148

[51] Int. Cl.[4] ..... B21D 7/04

[52] U.S. Cl. ..... 72/157; 72/159

[58] Field of Search ..... 72/149, 150, 154, 155, 72/156, 157, 158, 159, 319, 320, 321, 322, 323

[56] References Cited

U.S. PATENT DOCUMENTS

| | | | |
|---|---|---|---|
| 3,147,792 | 9/1964 | Hautau | 72/157 |
| 4,038,853 | 8/1977 | Schwarze | 72/157 |
| 4,085,608 | 4/1978 | Franks et al. | 72/150 X |
| 4,236,398 | 12/1980 | Schwarze | 72/157 |
| 4,416,136 | 11/1983 | Schwarze | 72/157 |
| 4,495,788 | 1/1985 | Traub | 72/157 |

FOREIGN PATENT DOCUMENTS

| | | | |
|---|---|---|---|
| 825279 | 1/1956 | Fed. Rep. of Germany | 72/157 |
| 1962590 | 6/1971 | Fed. Rep. of Germany | 72/157 |
| 2626202 | 6/1976 | Fed. Rep. of Germany . | |
| 2121756 | 8/1972 | France | 72/384 |

*Primary Examiner*—E. Michael Combs
*Attorney, Agent, or Firm*—Michael J. Striker

[57] ABSTRACT

A tube bending machine comprises a bending table carrying a bending template and a clamping jaw for receiving a tube to be bent therebetween. The template and the clamping jaw are each formed with a recess to receive various clamping members. Each clamping member is movable into and away from the recess in the template or the clamping jaw so that different clamping members having different clamping surfaces are positioned against each other to clamp a tube being bent.

20 Claims, 24 Drawing Figures

FIG.17
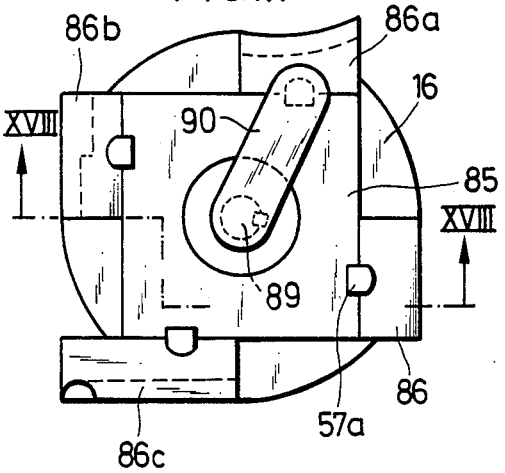
FIG.18
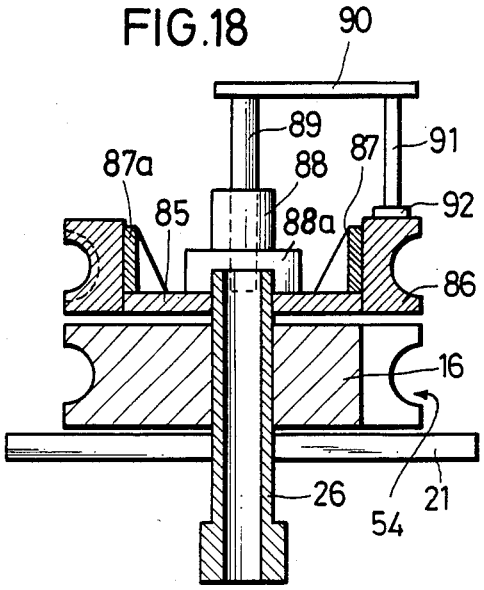
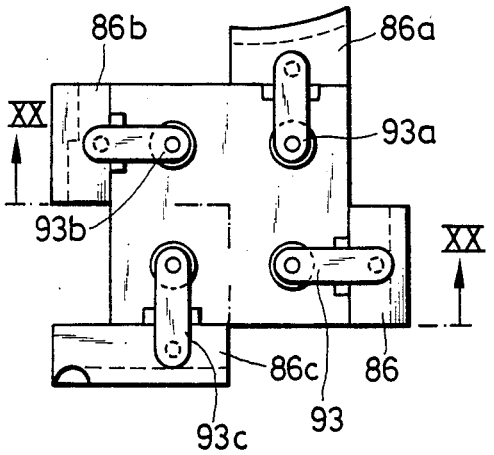
FIG.19
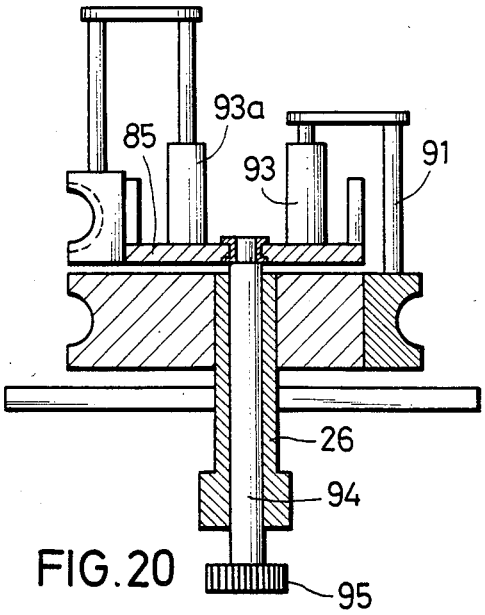
FIG.20

TUBE BENDING MACHINE

BACKGROUND OF THE INVENTION

The present invention relates to a tube bending machine which includes a bending table tiltable about an axis and has a bending template, a clamping jaw movable toward and away from the bending template and a feeding carriage including a releasable clamping collet which is movable toward the bending template.

Bending machines of the type under discussion have been disclosed in applicant's U.S. Pat. Nos. 4,137,743; 4,236,398; 4,311,031. One of such bending machines has been also described in German Pat. No. 2,626,202.

In many instances in such machines it is necessary to make successive bends with a different bending radius. Therefore templates with different clamping surfaces have been utilized.

SUMMARY OF THE INVENTION

It is an object of the present invention to provide an improved bending machine, It is a further object of the invention to substantially reduce costs of manufacturing of various templates required in the bending machine of the type under discussion.

It is still another object of the invention to provide a bending machine in which template or clamping surfaces for making various successive bends on the tube being processed would be easily interchanged without requiring many templates with differing radii.

These and other objects of the invention are attained by a tube bending machine, comprising support means; a bending table mounted on said support means tiltable about an axis; first clamping means including at least two first clamping surfaces each for clamping a portion of a tube to be bent; second clamping means including at least two second clamping surfaces each for clamping a portion of a tube being bent against said first clamping means; template means for receiving and supporting said first clamping means and mounted on said bending table; jaw means for receiving and supporting said second clamping means and mounted on said bending table; a displaceable carriage means including a turnable collet for guiding a tube to be bent in a longitudinal direction towards said template means, said template means and said jaw means being movable towards and away from each other to place the respective first clamping surface and the respective second clamping surface into an operative position in which a tube being bent is clamped between the respective first and the second clamping surface or to place the respective first and the respective second clamping surface at a distance from each other, said template means including a first supporting recess and said jaw means including a second supporting recess, said first supporting recess receiving said first clamping means and said second supporting recess receiving said second clamping means so that each of the first clamping surfaces can be interchangeably positioned with respect to each of the second clamping surfaces; and drive means for each clamping means for moving each clamping means in a vertical direction into or away from contact with the respective supporting recess, said template means and said jaw means being movable towards and away from each other when each clamping means is in contact with the respective supporting recess.

According to the invention the clamping means carrying a required clamping or template surface can be positioned in the recess of the template means or the opposite jaw means so that the required clamping surfaces can be positioned against each other and can be interchanged with other clamping surfaces.

Each clamping means can include at least two clamping members each carrying the respective clamping or template surface. Each clamping member can be automatically placed into the respective supporting recess to place the required clamping surface into the operative position opposite another required clamping surface. Thereby the manufacturing of the template itself will be substantially facilitated. Furthermore, the template is useful over a greater area of its periphery.

It is also significant that the clamping means can be so mounted on the template or in cooperation with the template that a required bending of the tubes would be ensured. Thereby it is possible to provide in the vicinity of the template or in cooperation with the template a so-called fold smoothener which is positioned opposite to the template. The fold smoothener is utilized because during the bending operation the wall thickness on the outer side of the tube being bent is reduced due to the extension of the tubes and the wall thickness on the inner side of the tube is not increased due to the bulging and a fold is formed. Due to the invention a number of additional devices can be easily mounted in the proximity of the template because the interchangeable clamping members require a very small space.

The provision of interchangeable clamping members having various clamping surfaces makes it possible that tubes of various shapes and diameters can be manufactured. For example, a tube can be thickened on its front end and after being bent joined to another tube. A tube, for example with a flange welded thereto can be manufactured.

It is often required that a tube should be first bent and then brought at its front end to a connection member. Such a manufacturing is facilitated with the present invention because the connection member is inserted into the bending machine and applied to the tube before the latter has been bent. Thereby the fastening of the connection member to the tube, which usually requires welding or soldering can be automatically carried out with the straight-line tubes in the bending machine of the invention. A plurality of clamping members with various clamping surfaces can be employed in this bending machine.

The clamping members are adapted to be vertically moved into and from the respective recess formed in the template or the clamping jaw mounted opposite to the tamplate. During such a movement the walls of the clamping members and the walls of the recess are flatly positioned against each other so that the precision of the bend of the tube inserted between the respective clamping surfaces is ensured under high bending loads.

The present invention provides for a quick exchange of the clamping surfaces in the clamping means.

A further possibility of the tube bending machine according to the invention is that the size of the template and the number of the required clamping surfaces can be easily adjusted to each other. Two, or three or even four or five clamping members with respective clamping surfaces can be employed and interchanged with one another so that tubes of individual size or tubes of various sizes can be bent in the same bending machine.

According to a further feature of the invention each of said drive means may include a hydraulic cylinder and a vertically extendable piston rod, the cylinders of each drive means being connected to the clamping members, respectively, the piston rods of said drive means being connected to the template means and to the jaw means respectively, said clamping members being vertically movable upon a vertical displacement of said cylinders. This embodiment suggests that one clamping means can have two superimposed clamping surfaces, of which one surface can be curved and another one can be straight-line, and to interchange these surfaces the clamping means should be displaced in the vertical direction.

According to a further feature of the invention each drive means may include a hydraulic cylinder and a vertically extendable piston rod, and a horizontally extended shaft pivotally connected to said cylinder and each clamping means, said hydraulic cylinder being operative for moving one of said clamping members into and from said recess, each drive means further including a hydromotor connected to said shaft for rotating thereof so that after moving one of said clamping members away from said recess said clamping members are rotated by said hydromotor to interchange the position of each of said clamping members relative to said recess and permit said hydraulic cylinder to move another of said clamping members into said recess. This solution suggests that in addition to the displacement of the clamping members in the vertical direction a transverse movement of the clamping members can be carried out. This transverse movement is in the above described instance a rotation movement. The above mentioned solution is especially simple and requires very small space.

Furthermore, each drive means may include a hydraulic cylinder and a piston rod, said cylinder being extendable in a vertical direction relative to said piston rod, the hydraulic cylinder of each drive means being connected to said template means and to said clamping means, respectively, each drive further including a pivot pin connected to the piston rod, a pivotable arm supported on said pivot pin and having two arm portions, each clamping member of each clamping means being rigidly connected to the respective arm portion of the respective drive means and being pivotable about said pin upon the vertical extension of said piston rod so as to be placed into and out from said recess.

According to still another feature of the invention each drive means further includes a horizontal arm connected to said piston rod, said horizontal arm having an extension projected downwardly and receiving said pin.

In a modified construction the drive means may include a horizontal guide bar, a plurality of hydraulic cylinders movable on said bar, said hydraulic cylinders having piston rods extended vertically downwardly from said cylinders and respectively connected to the clamping members, of both clamping means, said drive means being operated to move said clamping members in the horizontal direction and the vertical direction to interchangeably place said clamping members into the supporting recesses of said template means and said jaw means.

The template means may have a shaft extending upwardly from said template means and having an extension, said extension carrying a transverse, said bending table including a counter transverse, said drive means further including a horizontal rail extended between said transverse and said counter transverse and a supporting element movable on said horizontal rail, said hydraulic cylinders being mounted on said supporting element.

Two parallel rails may be provided extended between said first mentioned transverse and said counter transverse, said drive means further including a carriage movable on said parallel rails, parallel guide rails on said carriage, at least two of said hydraulic cylinders being movable on said guide rails horizontally to and from said template means to move horizontally respective clamping members connected to the piston rods of said two hydraulic cylinders.

A guide projection may be formed in the supporting recess of said template means and said jaw means, respectively, and a guide groove may be provided in each clamping member corresponding to said guide projection. When engaged the respective guide projection and guide groove form a nut-and-spring-connection.

The bending machine may further include another shaft extended through said template means and coaxially thereto, and a supporting plate rotatable with respect to said template means, said clamping means including a plurality of clamping members each having a respective clamping surface, said supporting plate carrying said clamping members, said clamping members being distributed over a periphery of said supporting plate.

The drive means of the first clamping means may include at least one piston-cylinder device, having a piston selectively engageable with one of said clamping members to place it into and out from the supporting recess in the template means.

A plurality of piston-cylinder devices may be provided on said supporting plate, each having a piston engaged with one of said clamping members. The construction with the supporting plate is particularly advantageous because a great number of the clamping members with various clamping surfaces can be distributed over the circumference of the supporting plate.

The supporting plate may be displaceable radially relative to said template means.

The supporting plate may be also displaceable to and from said template means in the direction of said another shaft. This contruction is advantageous for so-called multiple templates.

The supporting plate may include a cup-shaped portion and a flange, said flange supporting cylinders of said piston-cylinder devices and having openings through which piston rods of said piston-cylinder devices extend towards said template means.

The construction with the supporting plate is very compact and simple and presents no problems for inserting tubes being bent into the template means and removing those tubes from the template means. Any clamping member on the supporting plate can be preliminarily positioned in respect to the recess of the template in the vertical and radial direction and only then inserted into that recess. The construction with the supporting plate can be employed for the templates of various diameters. Furthermore, the supporting plate carrying the clamping members can be applied to any tube bending machine as an independent device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 17 is a top plan view of a supporting plate provided with pipe-clamping members;

FIG. 18 is a sectional view taken along line XVIII—XVIII of FIG. 17;

FIG. 19 is a top plan view of the modified supporting plate;

FIG. 20 is a sectional view taken along line XX—XX of FIG. 19;

DETAILED DESCRIPTION OF THE PREFERRED EMBODIMENTS

Figure 1:
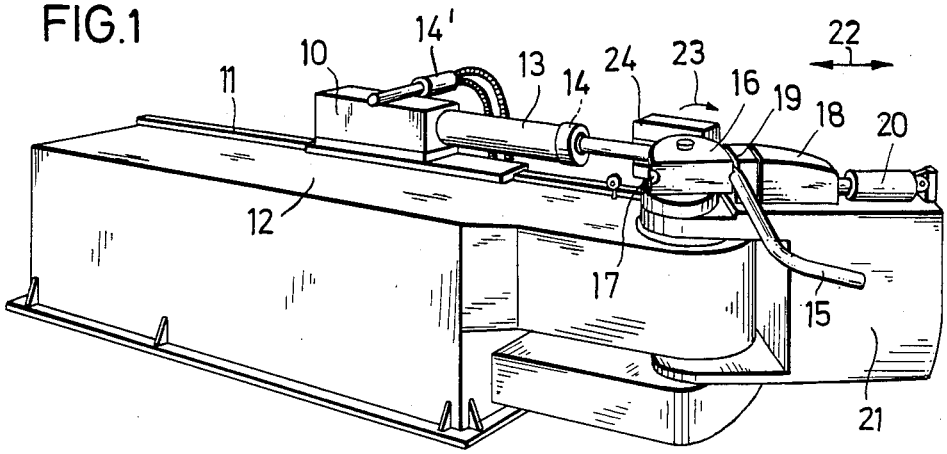
FIG. 1 is a perspective view of the tube bending machine.

Referring now to the drawings and firstly to FIG. 1 thereof, it will be seen that this figure illustrates a tube-bending machine which includes a housing 12 which carries at the front extension thereof a bending table 21 tiltable about a vertical axis. A feed carriage 10 is movable back and forth on a guide rail 11 provided on the upper side of machine housing 12. The feed carriage 10 has a hollow cylinder 13 in the interior of which a clamping collet 14 is held. The latter serves for clamping therein the end portion of the tube 15 to be bent. The tube piece 15 projecting beyond the clamping collet 14 is brought into engagement with the peripheral surface of a template 16. The latter is mounted on a turntable 21' coaxially arranged with the tilting axis of the bending table 21 and movable with the latter. The tube 15 is guided around the template 16, which has for this purpose a respective groove 17 of the size corresponding to the half of the tube diameter. The tube portion guided about template 16 is pressed onto the peripheral surface of the bending template by means of a clamping chuck or jaw 19 of a clamping device 18. The clamping jaw 19 has a corresponding groove which receives the tube 15 and forms a clamping surface opposite to the clamping surface provided on template 16 so that the tube 15 is clamped against the bending template 16. The chuck 18 with the clamping jaw 19 is operated to move to and from the bending template 16 by a piston of an operating cylinder 20. The template 16 is rigidly arranged on bending table 21 as mentioned above whereas the clamping chuck 18 is displaceabe relative to table 21 by means of hydraulic or pneumatic cylinder 20 in two opposite directions shown by arrows 22. If the bending template 16 is pivoted together with clamping jaw 19 in the direction of arrow 23 and in the region above bending table 21 tube 15 obtains a bend the profile of which corresponds to the peripheral surface of bending template 16. The end portion of tube 15 during the bending operation remains clamped in the collet 14 of the feed carriage 10 to ensure that the tube is guided in all positions. To prevent lateral buckling of the free portion of tube 15 between collet 14 and bending template 16 a guide element 24 having a longitudinal groove or recess receiving the portion of tube 15 and having the size corresponding to the half tube diameter is provided laterally of collet 14 and template 16. Clamping collet 14 of feed carriage 10 not only rigidly clamps the end of tube 15 but also turns the tube at the angles up to 360° when successive bends in various directions must be made on the tube. A hydraulic motor rotating a worm cooperating with a non-illustrated worm gear connected to clamping collet 14 serves for rotation of clamping collet 14 at various angles.

Figure 2:
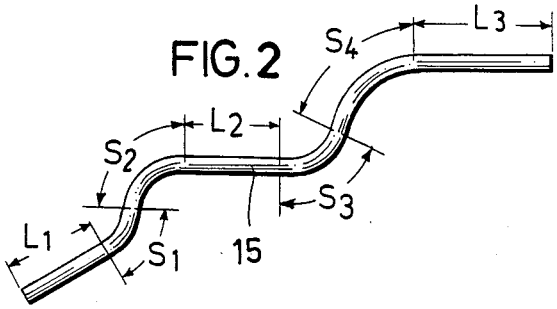
FIG. 2 is a view of a bent tube.

FIG. 2 illustrates a finished tube which has been manufactured in the bending machine according to the invention. The tube 15 has bent portions S1, S2, S3 and S4 and straight imtermediate portions L1, L2 and L3, which except portion L1 are not necessarily required.

The tube depicted in FIG. 2 has partially straight-line intermediate portions between the bends, as in the case of portions S2 and S3, and has no straight-line portions between the bends as in the case of portions S3 and S4. This tube can be manufactured at the bending machine during the single clamping in the machine. Such a machine is shown, for example in FIG. 3.

Figure 3:
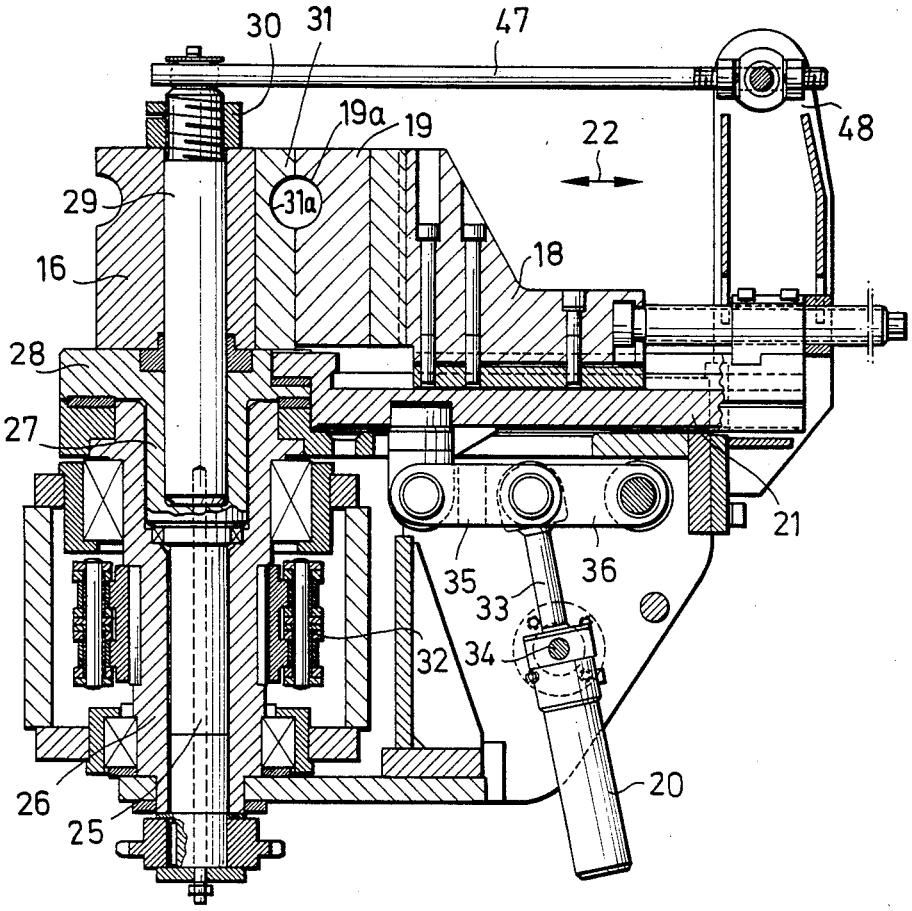
FIG. 3 is a sectional vertical view through a bending table with a bending template and a clamping jaw.

With reference to FIG. 3 it will be seen that the bending table 21 is turnable about an axle 25. The latter has a lower hollow shaft 26 in which another shaft 27 is coaxially positioned. Shaft 27 has in the upper region thereof a flange portion 28 on which bending template 16 is positioned. The bending template 16 is supported on a shaft 29 and is secured on this shaft in connection with a non-illustrated wedge against rotation. Reference numeral 18 denotes the clamping device. The clamping jaw 19 is an interchangeable member and has a clamping surface **19*a*. Another clamping member 31 which has a clamping surface 31*a* is provided on bending template 16, which is positioned opposite to the clamping surface 19*a* of clamping jaw 19**.

The bending table of the template and clamping jaw is rotated by means of a chain 32. The clamping device 18 with clamping jaw 19 is moved back and forth in the directions of double-headed arrow 22 by means of the piston rod 33 of cylinder 20 which is rigidly secured to bending table 21 through a shaft 34 and 36. These features of the invention are known.

Figure 4:
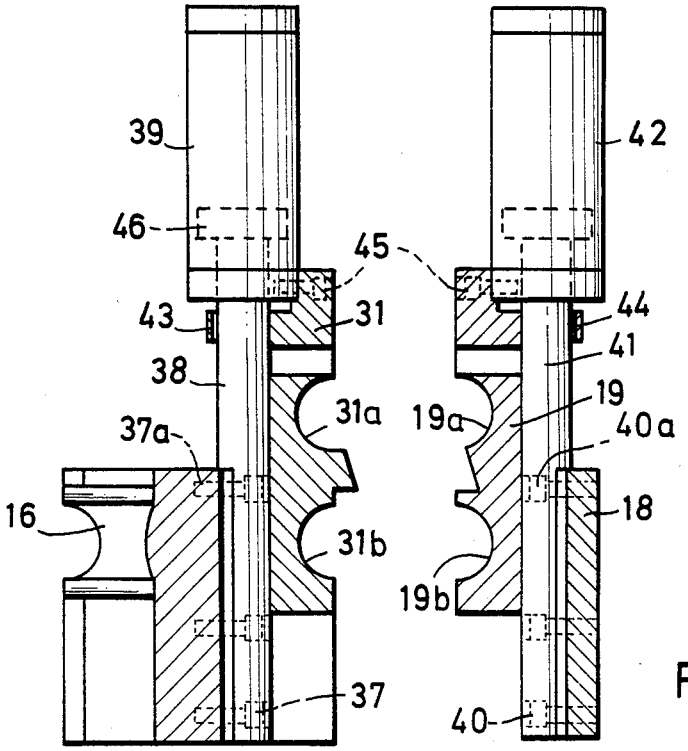
FIG. 4 is a sectional vertical view of the tube-clamping members in a first position.

FIG. 4 shows the bending template 16 on which the clamping member 31 is arranged, which has two clamping surfaces, namely an upper clamping surface 31*a* which is curved and a lower clamping surface 31*b* which is straight. Clamping member 19 is provided in the clamping device 18, member 19 also having two clamping surfaces, namely an upper curved clamping surface 19*a*, which lies opposite to the clamping surface 31*a* of template 16 and a lower clamping surface 19*b* which is positioned opposite to clamping surface 31*b* and is straight. A piston rod 41 of a hydraulic cylinder 42 is connected to clamping device 18 by means of bolts 40, 40*a*. Clamping members 19 and 31 have guides which guide these members on respective piston rods 38 and 41. Clamping member 31 has a yoke 43 which surrounds the piston rod 38 while clamping member 19 has a yoke 44.

Figure 5:
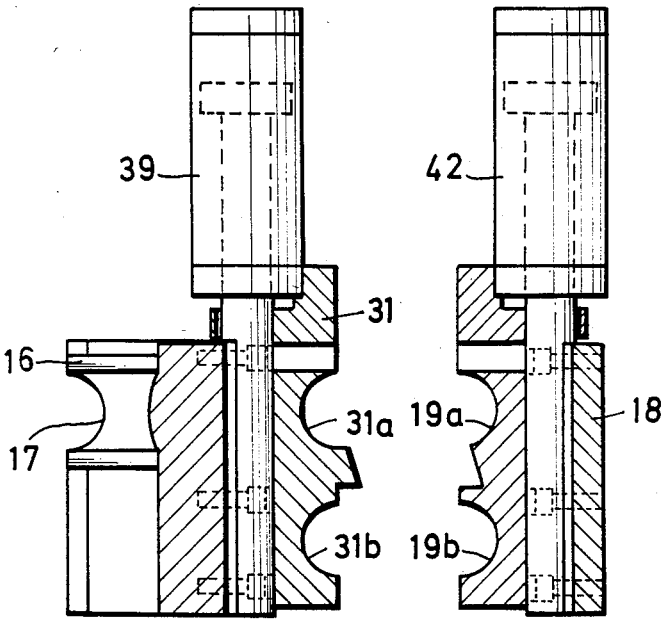
FIG. 5 is a sectional vertical view of the tube-clamping members in the position one against another.

Clamping member 31 is connected to hydraulic cylinder 39 by a bolt 45 and clamping member 19 is connected to hydraulic cylinder 42 by another bolt 45. FIG. 4 also shows that the lower position of piston 46 within cylinder 39 corresponds to the upper position of clamping member 31. Similar conditions are suggested for both opposite clamping surfaces. With reference to FIG. 5 it is observed that when the piston 46 is in its uppermost position within hydraulic cylinder 39 the latter together with clamping member 31 rigidly connected thereto is moved downwardly and thereby the upper clamping surface 31*a* comes into the plane of groove 17 in template 16 for cooperation with that groove. The same operation conditions exist for the opposite clamping surface 19*a* of clamping member 19. It is to be understood that more than two various clamping surfaces can be provided one below another in the same manner as surfaces 31*a*, 31*b* and 19*a*, 19*b* in the clamping members according to the invention. This assumes such a position of template 16 in the vertical direction that this template can be pulled out upwardly by means of a rod 47 one end of which is connected to shaft 29 and the other end of which is supported on a stand 48 of bending table 21 as can be seen from FIG. 3.

Figure 6:
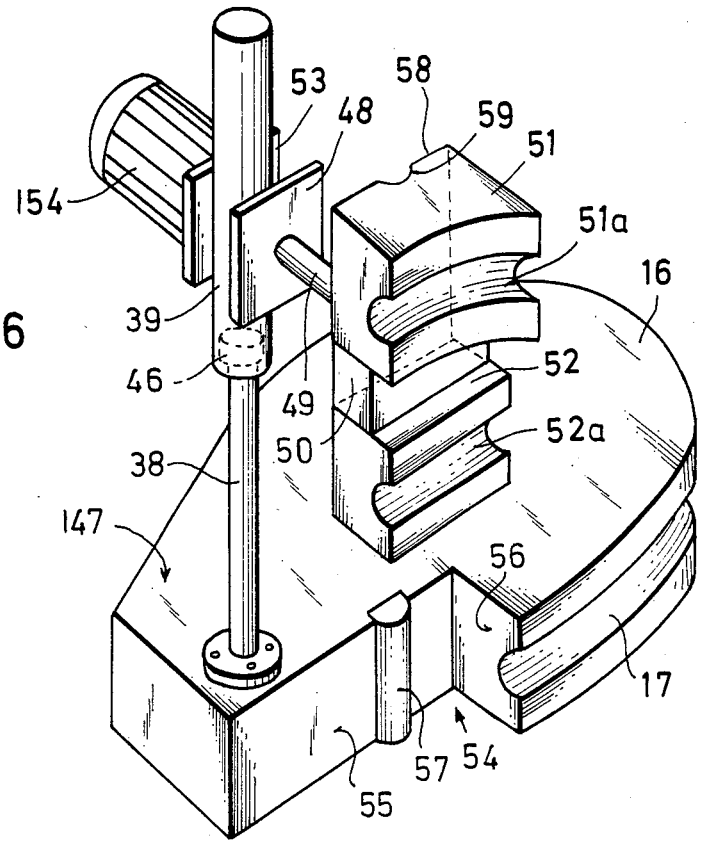
FIG. 6 is a perspective view of the bending template with two interexchangeable tube-clamping members in the upper neutral or inoperative position.
Figure 7:
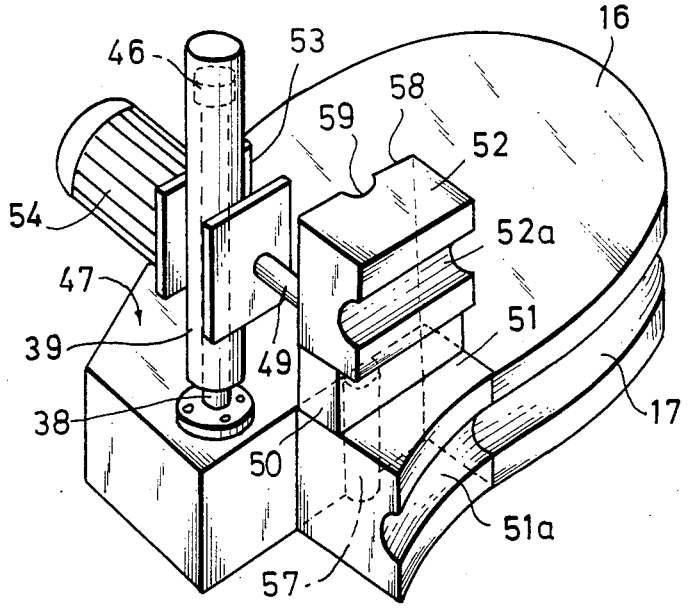
FIG. 7 is a perspective view of the bending template of FIG. 6 but with the tube-clamping members with curved clamping surfaces and in the operative position.

FIGS. 6 and 7 show the embodiment in which template 16 has the usual height and is arranged far above the bending table. This is obtained because piston rod 38 is connected to the upper side 147 of template 16. Piston rod 38 has the piston 46 at the upper end thereof, which is movable in the cylinder 39 similarly to the embodiment of FIGS. 4 and 5. A shaft 45 is connected to cylinder 39 by a holding element 48 mounted to the outer surface of cylinder 39. A clamping member 51 with an curved clamping surface 51*a* and another lower clamping member 52 with a straight-line clamping surface 52*a* are connected by means of a connecting plate 50 to shaft 49. A further supporting element 53 is attached to the outer surface of cylinder 39 to hold a hydraulic drive motor 154 which sets into rotation shaft 49 and thereby brings either the clamping member 51 or 52 into the position near the upper surface 147 of template 16. As soon as the required clamping member is placed in the vicinity of surface 147 cylinder 39 is moved in the downward direction in the same fashion as has been described for the embodiment of FIGS. 4 and 5 to place the required clamping member into the operative position shown in FIG. 7. Piston 46 is then in its upper position in cylinder 39. FIG. 7 shows that after the preliminary turning of shaft 49 about 180° clamping member 51 with the curved clamping surface takes up the lower position and is then moved into a recess 54 provided in the template 16. Recess 54 is formed by two surfaces 55 and 56. A rounded strip 57 projecting outwardly is provided on surface 55. A corresponding rounded recess 59 is provided on the rear face 59 of each clamping member 51 or 52. Outwardly projecting strip or extension 57 can be also formed on surface 56 of the template. Due to the provision of recesses 59 and strip-like projections 57 a vertical guiding of each clamping member and snug position in recess 54 is provided in the manner of a recess-spring.

Figure 8:
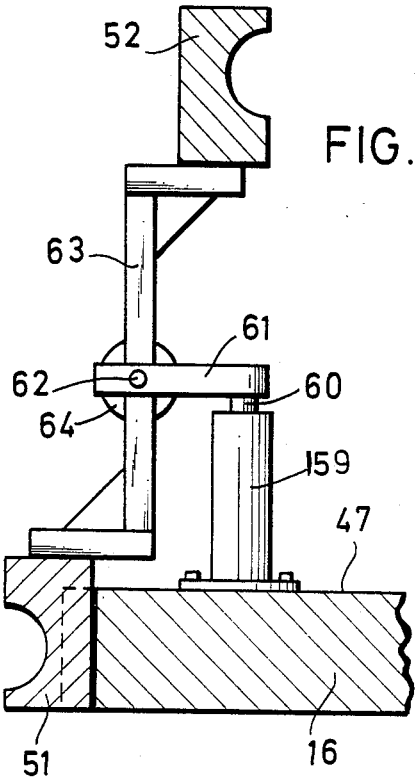
FIG. 8 is a vertical sectional view of the bending template with a modified device for changing the tube-clamping surfaces.
Figure 9:
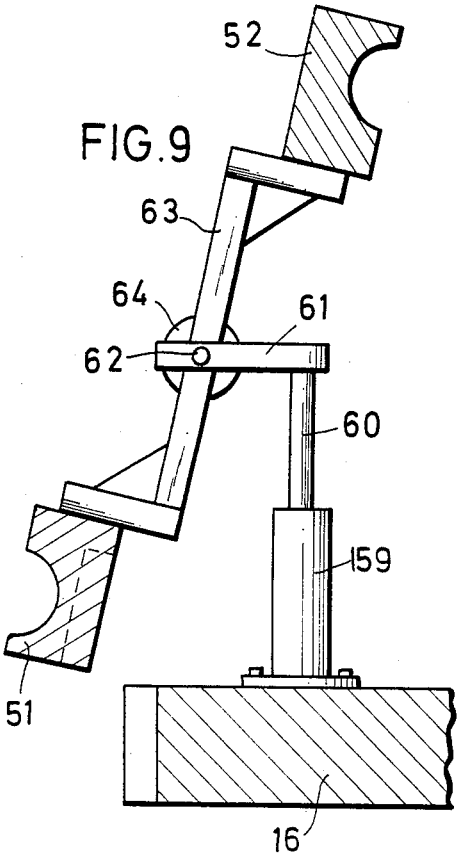
FIG. 9 is the view of FIG. 8 but in the position of changing of the tube-clamping member.

FIG. 8 illustrates the embodiment in which a hydralic cylinder 159 is fastened by screws to the upper side 147 of template 16. The piston rod 60 of cylinder 159 has a transverse arm 61 which through a horizontal pivot pin 62 is connected to a pivotable lever 63 which has two end arms directed in opposite directions, one of those end arms carrying clamping member 51 and another of the end arms carrying the clamping member 52. Pin 62 is rotated by means of a hydromotor 64. With reference to FIG. 9 it is seen that piston rod 60 is pulled out from cylinder 159 before lever 63 is rotated about the horizontal pin 62.

Figure 10:
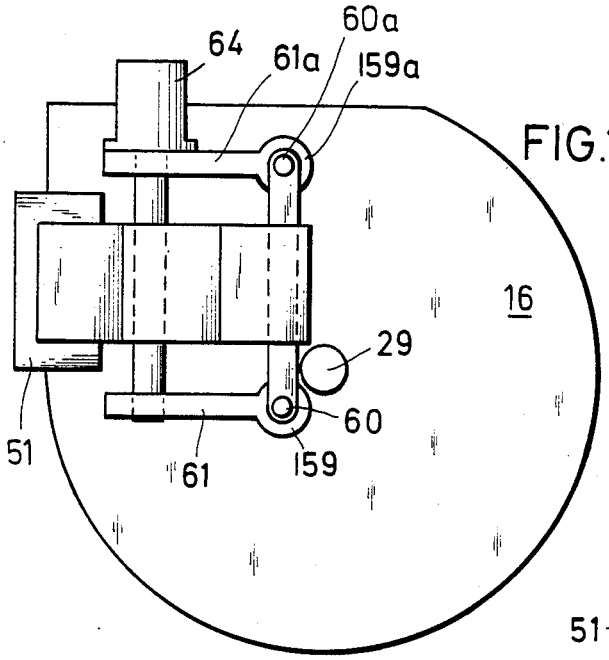
FIG. 10 is a top plan view of the template of FIG. 8.

Referring to FIG. 10 it is observed that two hydraulic cylinders 159 and 159*a* and respective arms 61 and 61*a* connected to the respective piston rods 60, 60*a* of the hydraulic cylinders can be provided. The hydromotor 64 and arm 61 are shown in FIG. 10 in the operative position with clamping member 51.

Figure 11:
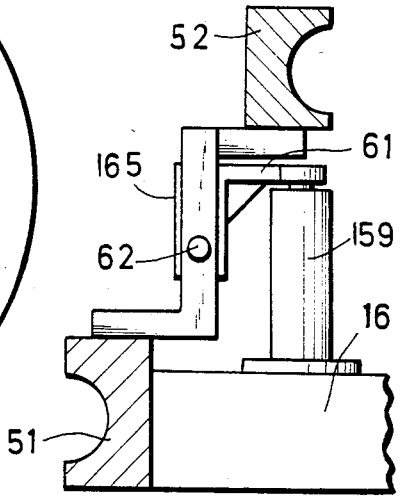
FIG. 11 is a partial view of the template, partially in section of a modified embodiment of the invention.

According to the embodiment of FIG. 11 connecting arm 61 has a further arm portion 165 which is extended downwardly, the aforementioned pivot pin 62 being arranged on the arm portion 165. In this embodiment the adjustment of members 51, 52 to smaller height levels can be obtained. The piston rod 60 in the embodiment of FIG. 11 can also pulled out upwardly and thereby clamping member 51 will be pulled out from the aforementioned recess 54 of template 16.

Then, the rotation at 180° about pin 62 follows, which rotation can be carried out in one or another direction.

Figure 12:
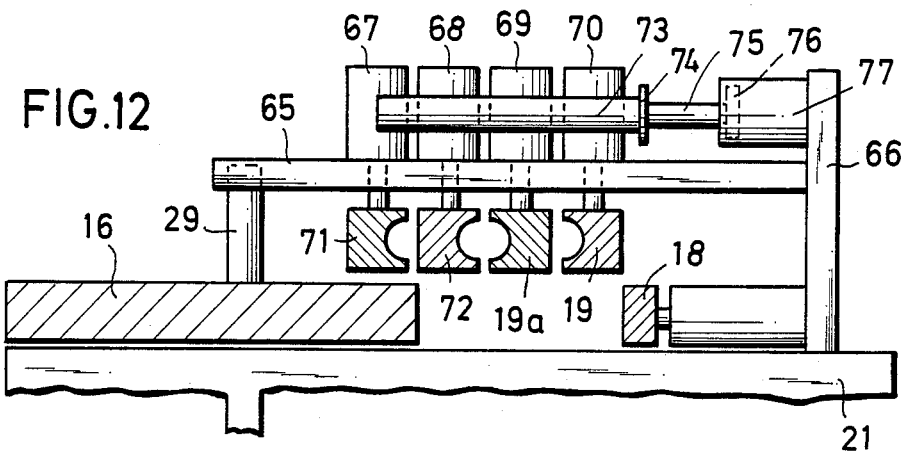
FIG. 12 is the modified embodiment with a plurality of interchangeable tube-clamping surfaces.

In the embodiment illustrated in FIG. 12, which shows the side, partially sectioned view of the tube-clamping arrangement, more than two clamping members with corresponding clamping surfaces are provided. In this construction, a rail 65 is provided, which is secured against rotation on the aforementioned elongated shaft 29 described in connection with FIG. 3 and projected upwardly from the bending template. Rail 65 is positioned at the sufficient distance from template 16 in the vertical direction. This distance is somewhat greater than the height of the clamping member with a respective clamping surface. Rail 65 extends in the horizontal plane and is supported at the end thereof on a cantilever 66 which is supported on bending table 21. A number of hydraulic cylinders 67, 68, 69 and 70 provided with respective piston rods are slidably supported on rail 65. Clamping members 71 and 72 for insertion into the recess of template 16 and clamping members 19, 19*a* for insertion into the clamping device 18 are connected to the respective piston rods of the slidable cylinders. These cylinders are connected to each other by a support 73 which is coupled with a piston rod 75 by a connecting plate 74 and movable by the piston rod 75. Piston 76 of piston rod 75 is movable in a hydraulic cylinder 77 which in turn is connected to a cantilever or transverse 66 mounted to table 21.

Figure 13:
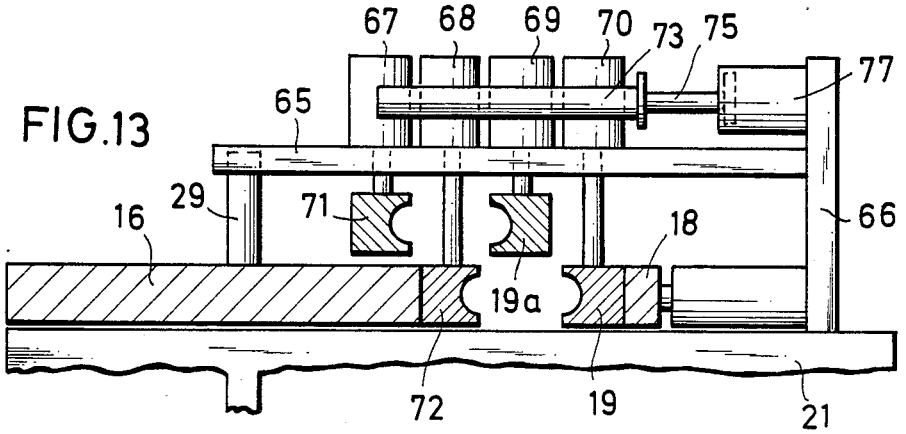
FIG. 13 is the view similar to that of FIG. 12 but with two tube-clamping members moved away from each other in the vertical direction.

FIG. 12 shows the position in which clamping member 72 is movable relative to template 16 and clamping member 19 is movable relative to the clamping device 18. The inserted position of clamping members 72 and 19 into template 16 and clamping device 18, respectively is shown in FIG. 13 when the piston rods of cylinders 68 and 69 are in the most extended positions.

Figure 14:
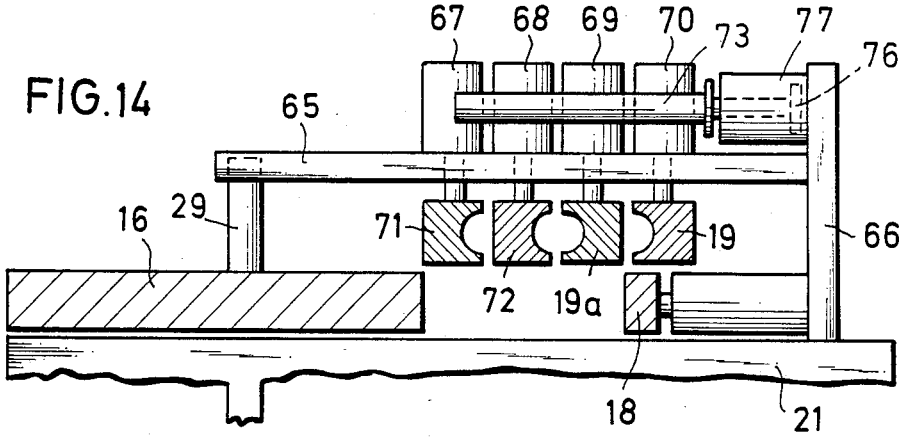
FIG. 14 is the view of the embodiment according to FIG. 12 but with two tube-clamping members which are horizontally displaceable relative to each other.

FIG. 14 shows the position in which clamping members 71 and 19*a* are displaced on the respective pistons in the rightward direction as seen in the drawing upon the displacement of piston 76 in cylinder 77.

Figure 15:
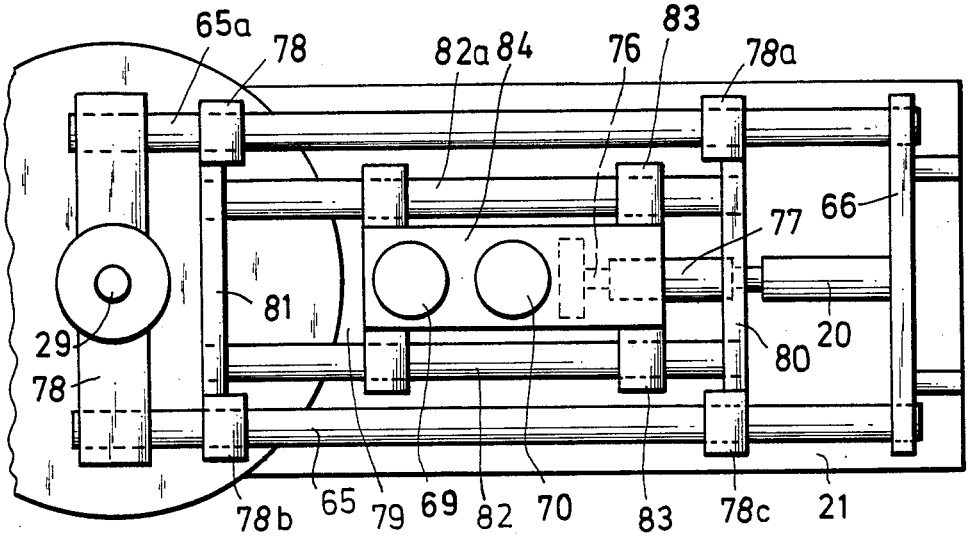
FIG. 15 is a top plan view of the further embodiment of the invention.

FIG. 15 depicts the modification of the embodiment of FIG. 12, in which a transverse 78 is provided on the end of shaft 29 operating as a pivot pin of the bending table 21 with the bending template. This transverse carries at two opposite ends thereof two rails 65 and 65*a* which are connected to cantilever 66 similarly to the embodiment of FIG. 12. Parallel rails 65 and 65*a* carry a slide or carriage 79 which is movable by means of four slide bearings 78, 78*a*, 78*b* and 78*c* on rails 65, 65*a* with the aid of the cylinder 20 (also shown in FIG. 1) connected to cantilever 66. The piston rod of cylinder 20 is connected to the transverse bar 80 of carriage 79 so as to exert pressure of the clamping jaw against the template 16 with the tube being bent interpositioned therebetween.

Carriage 71 has a further transverse bar 81 to which further parallel rails 82 and 82*a* are connected, which by means of slide bearings 83 carry a further smaller carriage 84 on which cylinders 69 and 70 described in connection with FIG. 12 are arranged. The respective piston rods of cylinders 69 and 70 as has been mentioned above carry the clamping members with the clamping surfaces, which are inserted into the clamping device 18 to form the clamping jaws 19 or 19*a*. The movement of the clamping arrangement of FIG. 15 in the horizontal plane is carried out by means of hydraulic cylinder 77 described in connection with the embodiment of FIG. 12. The piston rod 76 of cylinder 77 is connected to the carriage 84 to move the latter.

It is to be noted that the hydraulic cylinder with the piston rod shown in FIG. 15 can be also cylinder 20 with the piston rod 33 depicted in FIG. 3, which piston rod moves the clamping device 18 via the elbow lever connection to and from the bending template.

Figure 16:
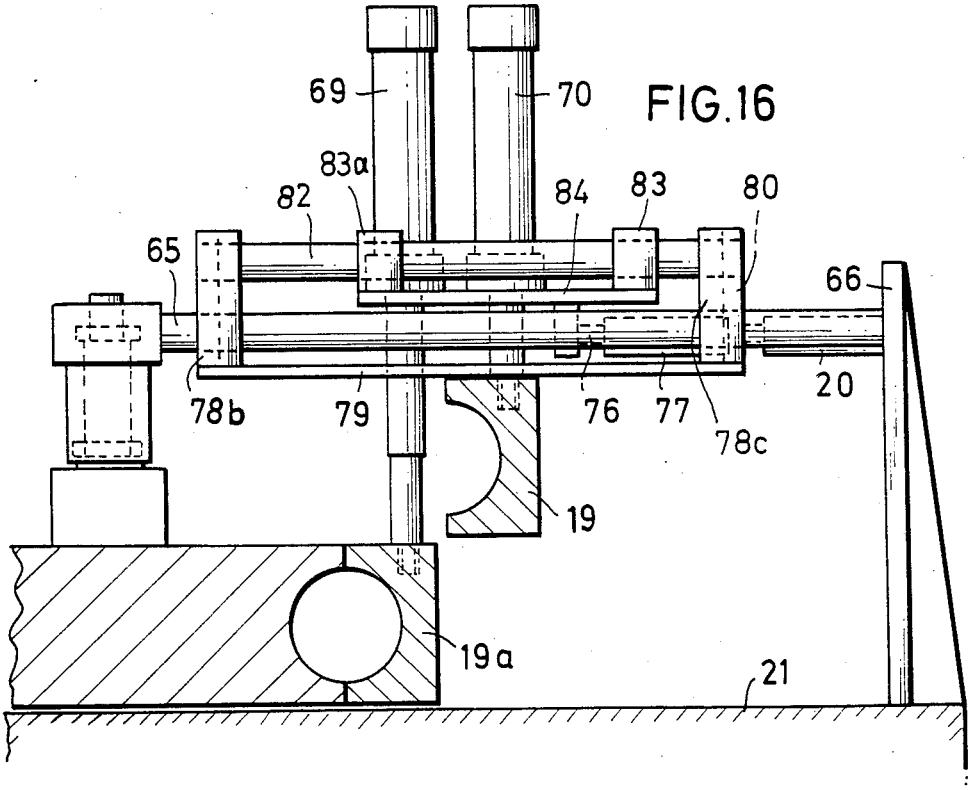
FIG. 16 is a side view of the embodiment of FIG. 15.

FIG. 16 shows a side view of the embodiment of FIG. 15. Two clamping members 19 and 19*a* have the respective clamping surfaces. Cylinders 69 and 70 are secured to the carriage 84 which with its bearings 83, 83*a* is movable on the rail 82 by means of piston 77 with the piston rod 76. FIG. 16 also shows the rail 65 connected to shaft 29, rails 82 and 82*a* and carriage 84 which is movable by cylinder 77 with piston 76 in the above described manner. Carriage 79 is actuated by cylinder 20 so that when this cylinder first cooperates with the clamping device clamping member 19 with the respective clamping surface or clamping member 19*a* with its clamping surface is displaced with the force required for bending a tube being processed in the direction towards the bending template 16 and the tube is clamped against the template.

FIG. 17 illustrates the top plan view of template 16. A square supporting plate 85 is mounted above template 16. Plate 85 has mounted to each side thereof clamping members 86, 86*a*, 86*b* and 86*c*. The supporting plate is provided with guides 87, 87*a* for supporting the above mentioned clamping members. Guides 87, 87*a* shown in FIG. 18 have wedge elements 57*a* which act similarly to strip-like projections 57 of the embodiment of FIG. 6. The clamping member 18 is received in recess 54 of template 16 in which strip-like projection 57 is provided in the extension of wedge 57*a*. The template 16 in the embodiment of FIGS. 17 and 18 is rotated together with the bending table 21 via the shaft 26 as has been described for FIG. 3. The supporting plate 85 is secured at the upper end of the drive shaft 26. The rotation of supporting plate 85 about the axle 26 of bending template 16 is carried out by a hydromotor 88*a*. This means that the supporting plate 85 has its respective rotation drive which rotates the plate about the axis of the template 16 so as to selectively place clamping members 86, 86*a*, 86*b* and 86*c* in position above recess 54 of the bending template 16 and only then insert the respective clamping member into recess 54. The vertical movement of the clamping members into and out of recess 54 is provided by a lifting cylinder 88, on the piston rod 89 of which an arm 90 is mounted, which is connected to the connecting bar 91, the latter being engageable via a coupling 92 with the clamping member 86 to move the latter in the vertical direction.

It is particularly advantageous when each clamping member 86, 86*a*, 86*b* or 86*c* is provided with an individual piston-cylinder arrangement 93, 93*a*, 93*b* or 93*c*. The advantage of this solution is that each clamping member is always connected to the respective rod 91 and this connection serves at the same time for supporting the supporting plate 85. A quicker change of the clamping member is thereby obtained.

As seen from FIG. 20 the supporting plate and all the clamping members are lifted and lowered by means of a shaft 94 having a toothed gear 95 and mounted within drive shaft 26 of the bending template 16. Toothed gear 95 which is in mesh with a non-illustrated drive chain of the rotation motor rotates shaft 94. It is also possible that supporting plate 85 would have a rotation motor which would rotate the supporting plate relative to the bending template so as to position the required clamping member in alignment with and above recess 54 of the template. Such a motor can be a hydromotor. An electromotor can also serve this purpose. Such a solution, which provides for the drive for lifting and lowering the clamping members and the rotation of the supporting plate on another supporting plate is advantageous because it takes possible that some additional elements of the bending machine could be provided above the bending template.

Figure 21:
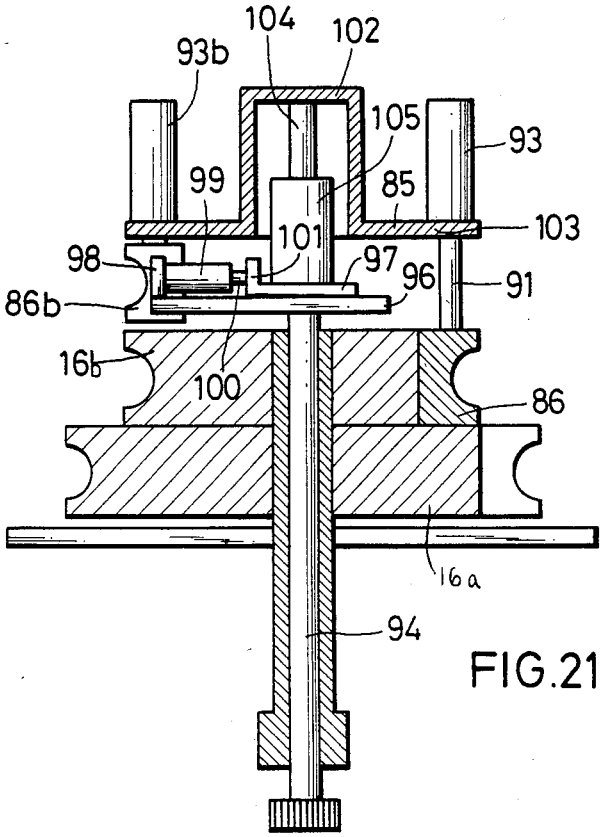
FIG. 21 is a sectional view taken along line XXI—XXI of FIG. 22 and showing a multiple template.
Figure 22:
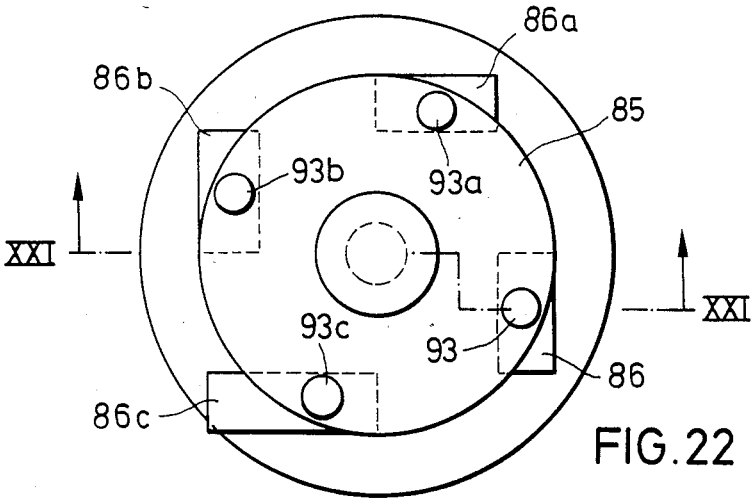
FIG. 22 is a top plan view of the bending template.
Figure 23:
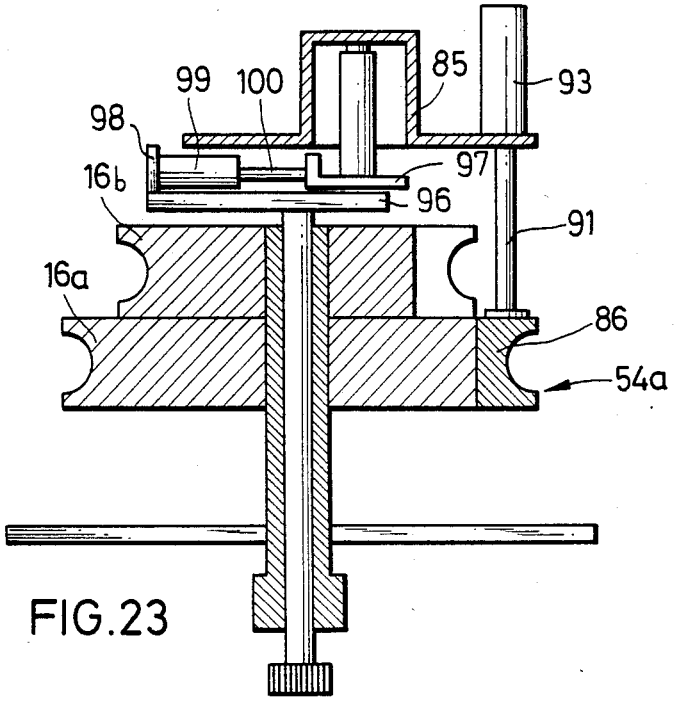
FIG. 23 is the view of the template of FIG. 21 with the template displaceable in the radial direction.
Figure 24:
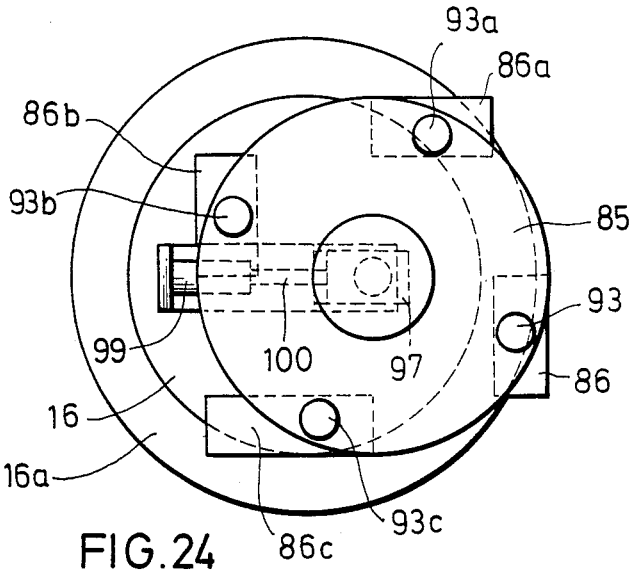
FIG. 24 is a top plan view of the template of FIG. 23.

In the embodiment of FIGS. 21 and 22 the supporting plate is displaceable radially with respect to the bending template. A radially extended guide 96 is mounted above bending template 16. The rotation axle or shaft 94 for rotating guide 96 is provided here similarly to the embodiment of FIG. 20. This axle 94 can also be provided on supporting plate 85, this axle being connected immediately to the upper side of the upper bending template 16*b*. The guide or rail 96 has a carriage 97 displaceable on rail 96. This displacement is provided by a cylinder 99 the piston rod 100 of which is connected to the carriage 97. Support 98 of the cylinder 99 is connected to rail 96. Two templates 16*a* and 16*b* are provided in this embodiment. The supporting plate 85 in the embodiment of FIGS. 21 and 22 has the shape of a container which includes a cup-like portion 102 and a flange portion 103 on which piston-cylinder arrangements 93, 93*a*, 93b and 93*c* are arranged and wherein as has been disclosed in connection with FIG. 18 the clamping member 86 is connected to the the piston rod 91. On the underside of the cup-like portion 102 is secured the piston rod 101 of cylinder 105 which serves the purpose of lifting and lowering the whole supporting plate 85. In FIG. 21 supporting plate 85 is shown in the lifted position, and the lowering of clamping member 86 into recess 54 (not shown) of the upper template 16*b* by means of cylinder 93 and its piston rod 91 is carried out. As can be seen from FIGS. 21–23 the lower template 16*a* has a greater diameter than that of the upper template 16*b*. If the lower template 16*a* is to be utilized as seen from FIG. 23 then the piston rod 104 is operated and supporting plate 85 is lowered whereby the clamping member 86 is inserted into recess 54*a* of the lower bending template 16*a* by means of the extended piston rod 91 of cylinder 93. Due to the fact that the lower template has a greater diameter the radial displacement of supporting plate 85 is necessary by means by piston-cylinder arrangement 99–100. Flange portion 103 of plate 85 has openings (not shown) through which piston rods 91 pass.

It will be understood that each of the elements described above, or two or more together, may also find a useful application in other types of tube bending machines differing from the types described above.

While the invention has been illustrated and described as embodied in a tube bending machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A tube bending machine, comprising support means; a bending table mounted on said support means tiltable about an axis; first clamping means including at least two first clamping surfaces each for clamping a portion of a tube to be bent; second clamping means including at least two second clamping surfaces each for clamping a portion of a tube being bent against said first clamping means; template means for receiving and supporting said first clamping means and mounted on said bending table; jaw means for receiving and supporting said second clamping means and mounted on said bending table; a displaceable carriage means including a turnable collet for guiding a tube to be bent in a longitudinal direction towards said template means, said template means and said jaw means being movable towards and away from each other to place a respective first clamping surface and a respective second clamping surface into an operative postion in which a tube being bent is clamped between said respective first and second clamping surfaces or to place said respective first and second clamping surfaces at a distance from each other, said template means including a first supporting recess and said jaw means including a second supporting recess, said first supporting recess receiving said first clamping means and said second supporting recess receiving said second clamping means so that each of said first clamping surfaces can be interchangeably positioned with respect to each of said second clamping surfaces; and drive means for each of said clamping means for moving each of said clamping means in a vertical direction into or away from contact with said respective first and second supporting recesses, said template means and said jaw means being movable towards and away from each other when each of said clamping means is in contact with said respective first and second supporting recesses.

2. the bending machine as defined in claim 1, wherein each of said drive means includes a hydraulic cylinder (39, 42) and a vertically extendable piston rod (38, 41), the cylinders of each drive means being connected to the clamping means, respectively, the piston rods of said drive means being connected to the template means and to the jaw means, respectively, said clamping means (31, 19) being vertically movable upon a vertical displacement of said cylinders.

3. The bending machine as defined in claim 1, wherein each clamping means includes at least two clamping members each having a respective clamping surface and mountable in a respective supporting recess.

4. The bending machine as defined in claim 3, each drive means including a hydraulic cylinder (39) and a vertically extendable piston rod (38) and a horizontally extended shaft (49) pivotally connected to said cylinder and each clamping means, said hydraulic cylinder being operative for moving one of said clamping members into and from said recess, each drive means further including a hydromotor (154) connected to said shaft (49) for rotating thereof so that after moving one of said clamping members away from said recess, said clamping members are rotated by said hydromotor to interchange the position of each of said clamping members relative to said recess, and permit said hydraulic cylinder to move another of said clamping members into said recess.

5. The bending machine as defined in claim 3, wherein each drive means includes a hydraulic cylinder (59) and a piston rod (60), said cylinder being extendable in a vertical direction relative to said piston rod, the hydraulic cylinder of each drive means being connected to said template means and to said clamping means respectively, each drive further including a pivot pin (62) connected to the piston rod, and a pivotable arm (63) supported on said pivot pin and having two arm portions, each clamping member of each clamping means being rigidly connected to the respective arm portion of the respective drive means and being pivotable about said pin upon the vertical extension of said piston rod so as to be placed into and out from said recess.

6. The bending machine as defined in claim 5, wherein each drive means further includes a horizontal arm (61) connected to said piston rod (60), said horizontal arm having an extension (165) projected downwardly and receiving said pin (62).

7. The bending machine as defined in claim 3, wherein said drive means includes a horizontal guide bar (65), a plurality of hydraulic cylinders (67, 68, 69, 70) movable on said bar, said hydraulic cylinders having piston rods extended vertically downwardly from said cylinders and respectively connected to the clamping members (71, 72, 19*a*, 19) of both clamping means, said drive means being operated to move said clamping members in the horizontal direction and the vertical direction to interchangeably place said clamping members into the supporting recesses of said template means and said jaw means.

8. The bending machine as defined in claim 7, wherein said template means has a shaft (29) extending upwardly from said template means and having an extension, said extension carrying a transverse (78), said bending table including a counter transverse (66), said drive means further including a horizontal rail (65) extended between said transverse (78) and said counter transverse (66), a supporting element (73) movable on said horizontal rail, said hydraulic cylinders (67, 68, 69, 70) being mounted on said supporting element.

9. The bending machine as defined in claim 8, wherein two parallel rails ( 65, 65*a*) are provided extended between said first mentioned transverse (78) and said counter transverse (66), said drive means further including a carriage (80, 81) movable on said parallel rails (65, 65*a*), parallel guide rails (82, 82*a*) on said carriage, at least two of said hydraulic cylinders (69, 70) being movable on said guide rails (82, 82*a*) horizontally to and from said template means to move horizontally respective clamping members connected to the piston rods of said two hydraulic cylinders.

10. The bending machine as defined in claim 3, wherein a guide projection is formed in the supporting recess of said template means and said jaw means, respectively, and a guide groove is provided in each clamping member corresponding to said guide projection.

11. The bending machine as defined in claim 1, further including another shaft (26) extended through said template means and coaxially thereto and a supporting plate (85) rotatable with respect to said template means, said clamping means including a plurality of clamping members (86, 86*a*, 86*b*, 86*c*) each having a respective clamping surface, said supporting plate carrying said clamping members, said clapping members being distributed over a periphery of said supporting plate.

12. The bending machine as defined in claim 11, wherein the drive means of said first clamping means includes at least one piston-cylinder device (88, 89) having a piston selectively engageable with one of said clamping members to place it into and out from the supporting recess in tne template means.

13. The bending machine as defined in claim 12, wherein said piston-cylinder device is hydraulic.

14. The bending machine as defined in claim 13, wherein said piston-cylinder device is pneumatic.

15. The bending machine as defined in claim 12, wherein a plurality of piston-cylinder devices are provided on said supporting plate, each having a piston engaged with one of said clamping members.

16. The bending machine as defined in claim 15, wherein said supporting plate is displaceable radially relative to said template means.

17. The bending machine as defined in claim 16, further including means for radially displacing said supporting plate (85) and including another piston-cylinder device (99, 100).

18. The bending machine as defined in claim 17, wherein said supporting plate (85) is displaceable to and from said template means in the direction of said another shaft (26).

19. The bending machine as defined in claim 18, further including means for displacing said supporting plate in the direction of said another shaft and incuding a piston-cylinder device (104, 105) mounted to said template means.

20. The bending machine as defined in claim 19, wherein said supporting plate includes a cup-shaped portion (102) and a flange portion (103), said flange portion supporting cylinders of said piston-cylinder devices and having openings through which piston rods of said piston-cylinder devices extend towards said template means.

* * * * *